United States Patent [19]

Myllylä et al.

[11] Patent Number: 4,640,514

[45] Date of Patent: Feb. 3, 1987

[54] OPTOELECTRONIC TARGET PRACTICE APPARATUS

[75] Inventors: Risto Myllylä ; Harri Kopola; Juha Kostamovaara; Raimo Ahola, all of Oulu, Finland

[73] Assignee: Noptel Ky, Dulu, Finland

[21] Appl. No.: 703,414

[22] Filed: Feb. 20, 1985

[30] Foreign Application Priority Data

Feb. 24, 1984 [FI] Finland ..... 840766

[51] Int. Cl.[4] ..... F41J 5/02

[52] U.S. Cl. ..... 273/310; 434/22

[58] Field of Search ..... 273/310, 311, 312; 362/110, 111, 113; 434/22

[56] References Cited

U.S. PATENT DOCUMENTS

| | | | |
|---|---|---|---|
| 2,659,606 | 11/1953 | Henry | 273/312 X |
| 3,471,945 | 10/1969 | Fleury | 362/110 X |
| 3,655,192 | 4/1972 | Hall et al. | 273/310 |
| 4,083,560 | 4/1978 | Kikuchi et al. | 434/22 X |
| 4,171,811 | 10/1979 | Meyer et al. | 273/310 |
| 4,234,911 | 11/1980 | Faith | 273/310 X |
| 4,352,665 | 10/1982 | Kimble et al. | 273/312 X |
| 4,367,516 | 1/1983 | Jacob | 273/310 X |

*Primary Examiner*—Anton O. Oechsle

[57] ABSTRACT

Designs of prior art art not usable in efficient dry-run target practice with hand firearms. The greatest drawbacks are, for instance, that it is not possible by the method to monitor the result of the dry-run training; that the method or means is not liable on ordinary guns without special measures or not at all or the method is so complicated that its implementation in practice causes that the means is too expensive to be in the personal possession and use of shooters. In order to eliminate said drawbacks, the invention is mainly characterized in that by a transmitter/receiver means attachable to conventional arms is emitted an optical beam towards a surface serving as the target which is set off from its surroundings due to its optic radiation reflecting properties relative to those of its surroundings, the hitting or missing of the beam being observed with the receiver on the basis of the return beam.

6 Claims, 4 Drawing Figures

OPTOELECTRONIC TARGET PRACTICE APPARATUS

BACKGROUND OF THE INVENTION

The present invention concerns apparatus for target practice with hand firearms, such as pistols and rifles, based on a transmitter/receiver means attachable to common firearms and on a target which is set off from its surroundings due to its different optic radiation reflecting properties.

In training shooting, especially sports shooting, the importance of so-called dry-run training is very high. The importance of dry-run training, that is, training with a gun without actually shooting, is accentuated by the fact that it is possible to practise it safely, for instance, in ordinary room. Nowadays, the problem is primarily how to motivate the trainees to do adequate and careful aiming and firing exercises without cartridges. Another problem is that there are no efficient methods known in the present art for immediate checking on the result of dry-run training, with the exception of the method described in the Finnish patent application No. 831183.

The method disclosed in said patent application is, however, intended to be used in the first place as a versatile shooting analyzing method in training shooters, whereby an important utilization mode of the means based thereon is its appplication in a real target practice situation. Probably the most important and valuable measurement datum of the method disclosed in the Finnish patent application No. 831183 is continuous monitoring of the aiming point during aiming and firing. If said idea is implemented in practice it implies a rather costly means which cannot in general be acquired for private property and use.

Designs of prior art involving the use of light in connection with target practice have been mentioned, for instance, in the Finnish patent application mentioned in the foregoing and in the Norwegian patent application No. 770997 (Utlegningsskrift nr. 144118). Summarizing the greatest drawbacks of the designs known in the art, the following may be mentioned: the method or the means is not applicable on common guns without special measures, or not at all (e.g. specific laser guns); the method is so versatile and complicated that to implement it in practice makes the means too expensive for the trainee to own and use personally.

OBJECTS OF THE INVENTION

In the present invention, a simple transmitter/-receiver means is attached to the gun with which target practice is going to be carried out. This means that each trainee may do his exercise e.g. with the gun which he will use in competitions. Since in the apparatus of the invention merely note is taken of whether the shot fired with the optic beam has fallen inside or outside a circumscribed area of desired size and shape, the target will be simple. The circumscribing of the optic target is carried out in that the target plate (or the plate and its surroundings) consist of surfaces which reflect light in different optic ways. In the simplest form, the optic target is e.g. a circular reflecting tape stuck on an ordinary backing surface (e.g., a wall), and the optic beam which is emitted is a light pulse narrow in divergence and diameter, whereby in practice the size of the tape alone determines the difficulty of scoring a hit (that is, the magnitude of the hit solid angle).

For the actual aiming plate, a separate plate can be used—and this is obviously also the most efficient way from the viewpoint of training. In this way, the aiming plate can be selected to conform as well as possible to the actual situation, and by changing the size of the optic target, the difficulty of scoring it can be regulated. Therefore, dry-run training can be carried out with ease at varying ranges, and it is still always known to what result the size of the optic target that is used would correspond in a real situation.

One form of training used by persons engaged in target practice is to record the number of rounds missing a circle of given size. When this is done, the area corresponding e.g. to the scores ten and nine is removed from the target, whereby only results which are inferior to this will be recorded. Equivalent dry-run training is easy to simulate with the means of the present invention.

For target practice training of biathlon sportsmen, the present invention described here is particularly well applicable because also in the competition only the hits are taken into account. In addition, the functional range ("the shooting range") of the means of the invention when implemented by modern technology extends up to several hundred meters, and therefore the shooting range may be chosen to equal the real range.

At its simplest, indication of hits or misses is effected with the aid of an acoustic or optic signal. If it is desired to record and store the hits/misses over a prolonged period of time, separate counters and display means can be connected to the means. Recognition of the firing moment may be with the aid of a sensor attached to the gun trigger, or on the basis of the energy pulse caused by firing the cocked gun (in which case the sensor may be accomodated in the same housing with the transmitter/receiver means).

BRIEF DESCRIPTION OF THE DRAWINGS

The invention is described in the following more in detail with the aid of an example, referring to the drawings attached, wherein.

DETAILED DESCRIPTION OF PREFERRED EMBODIMENT

Figure 1:
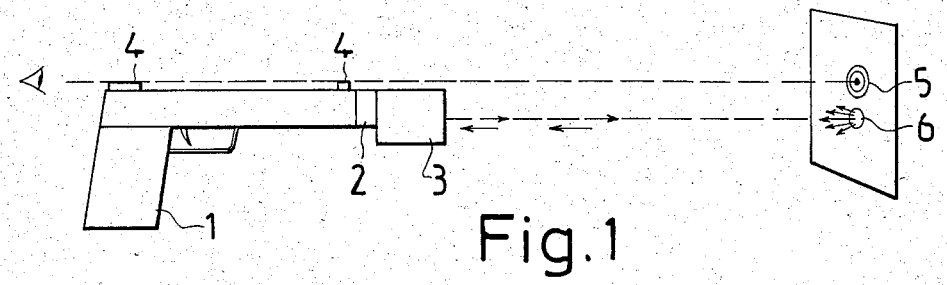
FIG. 1 presents a training apparatus according to the invention.

In FIG. 1, on a common pistol 1 has been mounted, with the aid of a magnet and a centering mandrel 2, a transmitter/receiver means 3. The parts contained in the transmitter/receiver means are depicted more in detail in FIGS. 2–4.

In addition to the parts 2 and 3 to be mounted on the gun, the apparatus comprises a target plate 5 and an optic reflecting plate 6 for the optic beam. When the cocked, unloaded gun is fired, a laser transmitter in the component 3 emits a narrow "optic bullet" towards the plate 6. The transmitter/receiver 3, the plates 5 and 6 and the sights 4 are so adjusted that when the sights 4 are aligned with the target plate 5 the narrow light beam emitted by the laser strikes the plate 6. The plate 6 is made e.g. of inexpensive reflecting foil having a reflectivity typically 100–1000 times that of conventional background surfaces (wood, paper, concrete, etc.). Thus, it is easy to notice with the receiver in the component 3 when the beam strikes the reflector 6. The size of the reflector determines, of course, how difficult it is to make hits with the means. Conversely, plate 6 could be made of a material having significantly less reflectivity than that of the background surface surrounding plate 6, and misses are detected by the receiver when light from the transmitter is reflected from the background surface.

Figure 2:
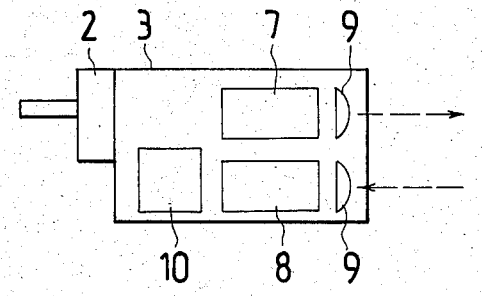
FIG. 2, the block diagram of the means.

In FIG. 2 is presented how the transmitter 7 and the receiver 8 are placed inside the component 3. The transmitter as well as and the receiver has simple optics 9, by which the laser light is collineated and the reflected light is focussed on the receiver. Moreover, the component 3 comprises a power source 10 (a storage or dry-cell battery) for power supply.

Figure 3:
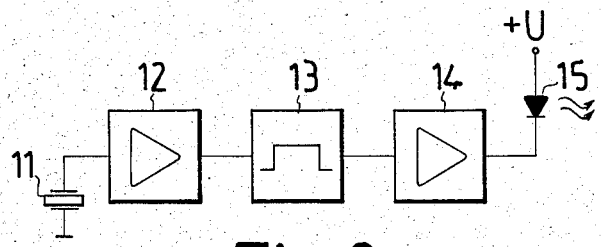
FIG. 3, the block diagram of the electronics of the transmitter.

In FIG. 3 is shown the block diagram of the transmitter electronics. The solid-transmitted sound in the gun produced by firing the unloaded cocked gun is detected with the aid of a piezo sensing element 11. The signal from the sensing element is amplified by an amplifier 12, which triggers a pulse of suitable size from the monostable vibrator 13 to the amplifier 14. The amplifier 14 in its turn controls a laser diode 15, whereby a light pulse corresponding to the firing is obtained from the transmitter.

In FIG. 4, again, is presented the block diagram of the receiver electronics. If the narrow light pulse emitted by the laser 15 strikes the reflecting plate 6, the reflected light is observed with the photodiode 16. The signal from the photodiode is amplified by the amplifier 17 and filtered by the filter 18. The pulse from the filter 18 triggers the monostable vibrator 19 if the pulse is powerful enough. The oscillator 20 oscillates during the duration of the pulse from the monostable vibrator 19, controlling the piezo buzzer 21. In this way, an acoustic signal is obtained from the buzzer 21 for each round that has hit the target. The buzzer may be easily replaced with a pilot light, for instance an LED.

The size and shape of the aiming plate 5 (FIG. 1) is so selected that at the practice range which is used the plate looks the same when aimed at as in the real shooting situation. If the trainee does not like to readjust the sights 4 of his gun for the duration of the dry-run exercise, the requisite aligning adjustment may be carried out by means of adjustable attachment of the transmitter/receiver means 3 and/or by changing the location of the plates 5 and 6 in relation to each other.

Figure 4:
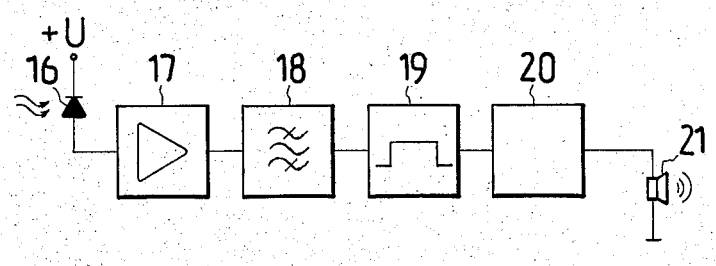
FIG. 4, the block diagram of the electronics of the receiver.

In order to eliminate the effect of interference; it may be advantageous to switch the detection in the receiver of FIG. 4 to be active only for a short time during the emitted light pulse. Synchronization is easy to achieve e.g. by connecting the emission datum from the monostable vibrator 13 of FIG. 3 to the control input of the monostable vibrator 19 of FIG. 4.

When the firing pin of the gun strikes the cap on the cartridge, it takes a while before the bullet that has been fired emerges from the muzzle of the gun. Only after this length of time the movements of the gun have no influence on the flight path of the bullet. This time can be taken into account in the transmitter of the target practice means, FIG. 3, by delaying the triggering of the laser 15 electronically, e.g. by means of a monostable vibrator. The greater part of the so-called barrel time, however, consists in practice of the motion of the trigger and firing pin mechanism (typically 2–5 ms) which is automatically taken into account when the piezo sensor 11 depicted in FIG. 3 is employed to detect the firing. The velocity of propagation of solid-transmitted sound (about 5000 m/s) is so high that it has no significance in practice.

It is obvious to a person skilled in the art that different embodiments of the invention are not merely confined to the example presented in the foregoing and that may vary within the scope of the claims presented below.

We claim:

1. An apparatus for dry-run target practice using firearms, such as pistols and rifles, which are to be used in competition, comprising: an integrated transmitter/-receiver means for attachment to the barrel of a firearm, and a target having one portion defining a first area for aiming the sights of the firearm and another portion separated therefrom and defining a second area which exhibits significantly different light reflectivity than that of a third area surrounding said second area, said first and second areas being variable independently of each other as to their size and position;

said transmitter/receiver means further comprising means for generating and transmitting a light beam pulse to said second or third area of said target exhibiting greater light reflectivity, upon actuation of the trigger of the firearm, means for receiving a reflected light beam pulse from said second or third area of greater reflectivity, and means for detecting and indicating that a reflected light beam has been received by said receiver means, whereby an operator of the firearm can ascertain whether or not he would have hit or missed the first area of the target at which he has aimed.

2. An apparatus according to claim 1, wherein the optic beam from the transmitter is as narrow as possible as to divergence and diameter, and said second area of said target has a surface of predetermined size which reflects light better than its surrounding area, and the difficulty of scoring a hit, or the size of the scoring solid angle is changed by changing the size of the reflector/-scattering surface.

3. An apparatus according to claim 1, wherein the optic beam from the transmitter is as narrow as possible as to divergence and diameter and said second area of said target has a surface of predetermined size which reflects light less than said third area, whereby said receiver detects light beam pulses which have hit the area around said second area.

4. An apparatus according to claim 1, wherein an acoustic sensor in the transmitter means is actuated by transmitted sound caused by firing the cocked gun, and said sensor actuates said means for generating and transmitting a light beam pulse.

5. An apparatus according to claim 1, wherein said means for indicating that a reflected light beam has been received by said receiving means is acoustic or optical.

6. An apparatus according to claim 1, wherein the transmitter means emits a single brief delayed light pulse after the moment of triggering the gun, with such a delay that the light pulse starting and recognition moment approximately corresponds to the moment at which a bullet would ordinarily emerge from the barrel of said gun.

* * * * *